US005943835A

United States Patent [19]

von Saint-George

[11] Patent Number: 5,943,835

[45] Date of Patent: Aug. 31, 1999

[54] METALLIC COMPONENTS FOR FORMING PARTS OF THE EXTERIOR WALLS OF BUILDINGS

[76] Inventor: Andreas von Saint-George, Stadelhoferstrasse 1, Baden-Baden, Germany

[21] Appl. No.: 08/899,926

[22] Filed: Jul. 24, 1997

[30] Foreign Application Priority Data

Jul. 26, 1996 [FR] France ..... 96 09478

[51] Int. Cl.[6] ..... E04B 2/00

[52] U.S. Cl. ..... 52/287.1; 52/288.1; 52/716.1

[58] Field of Search ..... 52/287.1, 288.1, 52/716.1; 428/99, 100

[56] References Cited

U.S. PATENT DOCUMENTS

| | | | |
|---|---|---|---|
| 1,449,745 | 3/1923 | Clapp . | |
| 4,012,878 | 3/1977 | Ellingson | 52/288.1 |
| 4,587,173 | 5/1986 | Lat et al. . | |
| 4,719,732 | 1/1988 | Bernard | 52/287.1 |
| 4,863,774 | 9/1989 | Tucker | 52/417 X |
| 4,876,837 | 10/1989 | Kelly et al. | 52/287.1 |
| 4,977,718 | 12/1990 | Hoffman | 52/288.1 |
| 5,131,198 | 7/1992 | Ritchie et al. | 52/287 |
| 5,138,810 | 8/1992 | Kartler | 52/254 |
| 5,442,886 | 8/1995 | Iacobelli | 52/255 |
| 5,508,078 | 4/1996 | Stainaker | 52/287.1 X |

FOREIGN PATENT DOCUMENTS

| | | |
|---|---|---|
| 712999 | 10/1931 | France . |
| 29512077 | 9/1995 | Germany . |

*Primary Examiner*—Beth Aubrey
*Attorney, Agent, or Firm*—Nilles & Nilles SC

[57] ABSTRACT

A metallic component has 1) a head intended to form a visible part of a surface of the exterior of a building and 2) at least one flange which has an aperture and which is intended to be covered with at least one coat of a render containing a mineral filler. The head is coated with a coat of a resin containing a mineral filler. The metal component is particularly useful as an angle section of a building.

20 Claims, 3 Drawing Sheets

METALLIC COMPONENTS FOR FORMING PARTS OF THE EXTERIOR WALLS OF BUILDINGS

BACKGROUND OF THE INVENTION

The field of the invention is the building industry. It relates to metallic components, more particularly those intended for forming parts of the exterior walls of buildings for habitation.

The exterior walls of a building are generally composed of masonry, for example building blocks, covered with one or two coats of render. In the application state, the render is a somewhat pasty and often colored material. Two main types are known: skin renders, consisting of a polymeric resin applied in thicknesses of about 3 mm, and hydraulic renders, containing a hydraulic binder, which are applied in thicknesses generally of between 12 and 25 mm. After drying or curing, the render enables walls to be obtained whose surfaces are regular and uniform, with no roughness, asperity or blistering. Furthermore, the render imparts impermeability properties on the walls.

Rendered exterior walls very often include metallic components whose visible head delimits a region or a part which is differentiated from the render not only by its strength but also, sometimes, by its shape or its color. These may, for example, be projecting ornamental parts, parts in the middle of panels, or corner parts lying, in particular, at the intersection of the walls or at points where there are cornices, bases or joints.

The metallic components are put into place at the same time as the render is applied, before application of one or both render coats, or therefore after application of a first render coat and before application of a second coat. This is the case, in particular, of metal angle sections which are put into place at the corner parts. These angle sections have 1), a head which forms the arris of the corner part of the building and 2), at least one flange, which is laid against the building blocks, then optionally covered with a first render coat, and then which covered with render coat.

These metallic components protect the arrises from being broken off. However, the head of these components, which is flush with the corners of the walls, is not protected against corrosion.

This is the reason why it is common practice to clip polyvinyl chloride (PVC) strips onto the heads of the metallic components. While, the protection provided by these PVC strips is effective, at least over time, the PVC may split or even break due to the effect of impact. Water then infiltrates as far as the metallic part of the component and possibly flows along this metallic part, eventually causing it to corrode. Moreover, it should be noted that the PVC strips are not esthetic since their appearance is necessarily substantially different from the appearance of the render.

With regard to the aforesaid, a problem which the invention proposes to solve is how to produce an impact-resistant component which is not prone to oxidation and whose appearance is fundamentally similar to the appearance of the render.

SUMMARY OF THE INVENTION

The solution of the invention consists in coating the head of the metallic component with a resin coat containing a mineral filler.

Thus, the subject of the invention is a metallic component having 1), a head intended to form a visible part of a surface of the exterior of a building and, 2), at least one flange which has at least one aperture and which is intended to be covered with at least one coat of a render containing a mineral filler. The head is coated with a coat of a resin containing a mineral filler.

BRIEF DESCRIPTION OF THE DRAWINGS

Other features and advantages of the invention will become apparent on reading the following illustrative embodiments which are given by way of illustration and in no way implying any limitation, and which must be read in conjunction with the appended drawings in which.

DESCRIPTION OF THE PREFERRED EMBODIMENTS

Figure 1A:
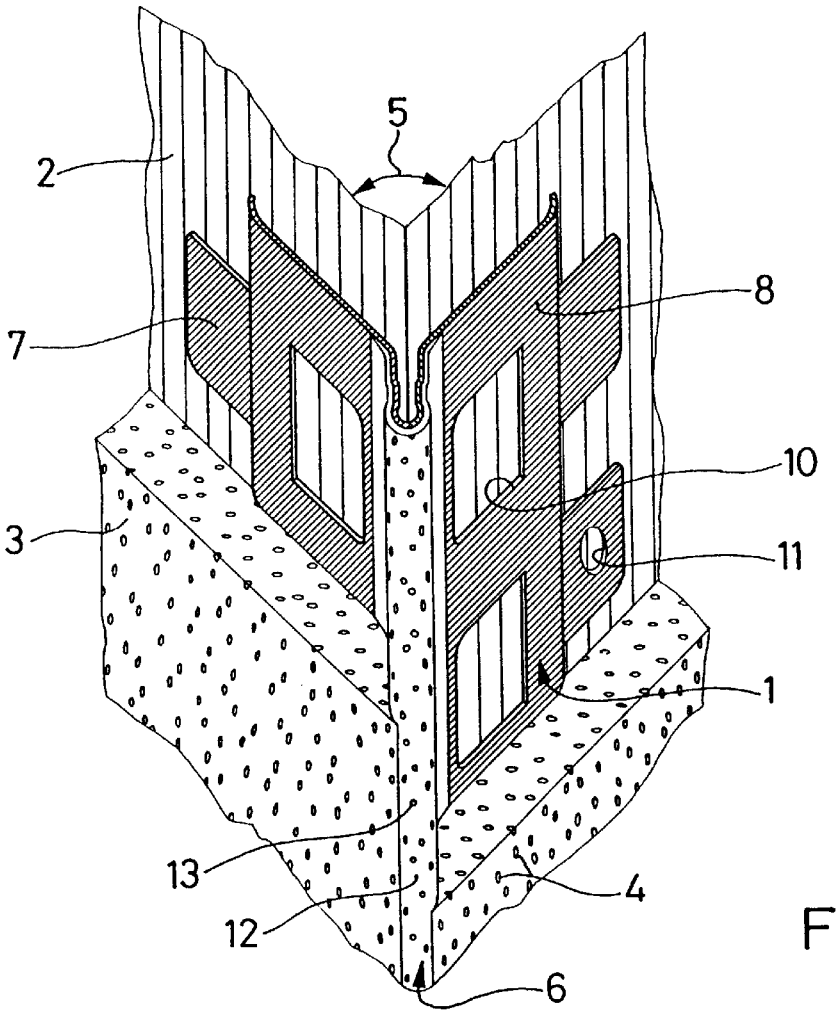
FIG. 1 shows, in perspective, a metallic component according to the invention, partially covered with a render.
FIG. 1*b* shows, in cross section, the component according to FIG. 1*a;*

Components of the invention are labeled 1 in FIGS. 1*a,* 1*b,* 2, 3 and 4. In the embodiment more particularly described in conjunction with FIGS. 1*a* and 1*b,* they are placed at the corner parts 5 of exterior walls of buildings, consisting of blocks 2 making up the masonry, onto which blocks one or two coats of a hydraulic render 3 have been applied. However, it is quite clear that the components of the invention may be placed at any part on the surface of a rendered exterior wall.

The render 3 is a mix of a cement, for example Portland cement, and a mineral filler, for example silica or calcium carbonate, the particles of which are labeled 4. It gives a uniform and regular appearance to the exterior walls and imparts impermeability properties thereon. It is applied in a somewhat pasty state using various operations, such as floating or skimming, before drying.

Figure 1B:
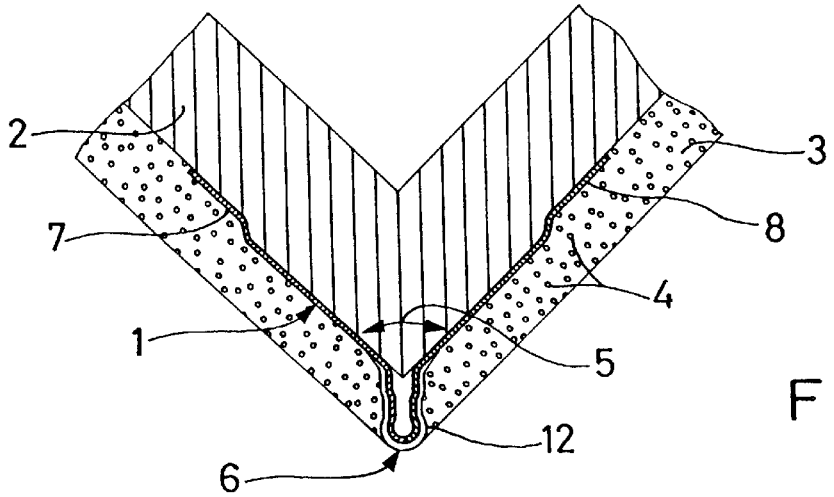
Figure 2:
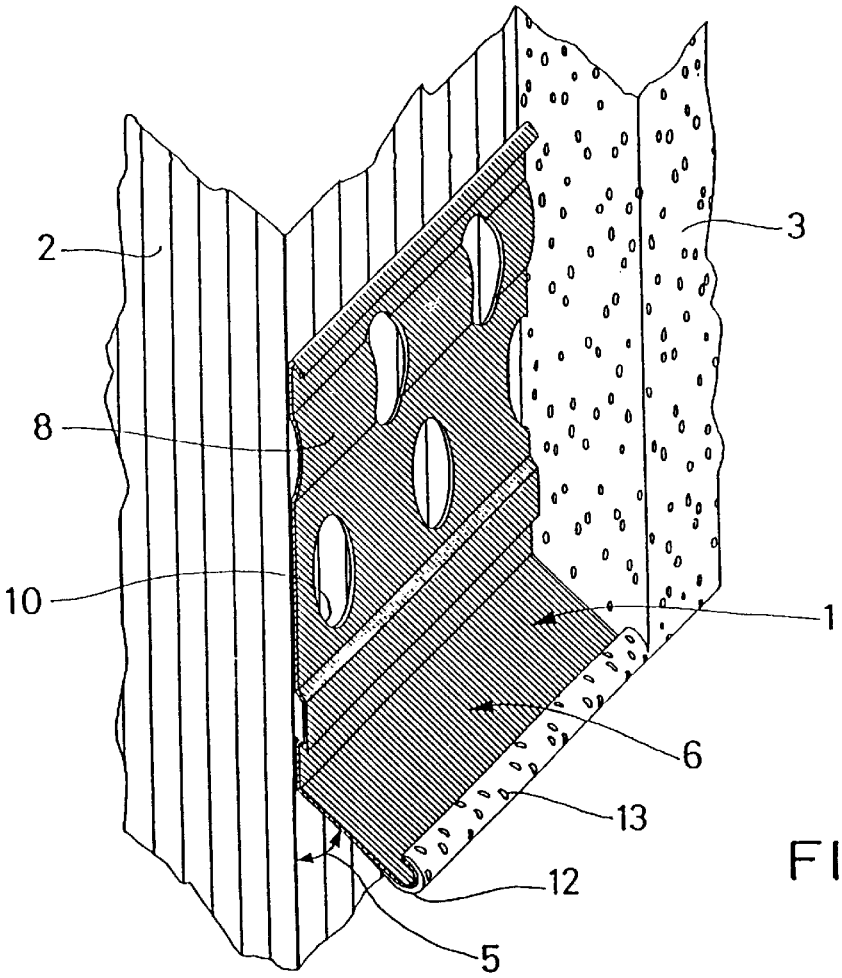
FIG. 2 shows, in perspective, a component according to the invention having only one metal flange and exhibiting a horizontal render arris function.

In FIGS. 1*a* and 1*b,* the corner part 5 lies at the corner between two walls. However, this corner part may be at cornices, bases, window frames or even purely ornamental reliefs on the surface of the walls. FIG. 2 gives an example of a corner part 5 which does not lie at the corner between two walls.

The components 1 consist of a metal plate which is folded, profiled or extruded, then perforated, and which is impact resistant. In particular, it is a stamped galvanized-steel or aluminum plate approximately 0.1 to 2 mm in thickness.

The components 1 have a protruding head 6 and one or two flanges 7, 8. Their dimensions are adapted to the corner part of the building. Thus, their length can very often be as much as 2 to 3 meters. However, the width of the flanges 7, 8 is more restricted, in one example this being between approximately 2 and 7 cm.

Moreover, these flanges 7, 8 have apertures 10, as well as anchoring holes 11. The apertures 10 are intended to allow the render 3 covering the flanges 7, 8 to pass through so as to hold the component 1 in place. In contrast, the anchoring holes 11 are intended to receive, optionally, a nail or a fixing means and thus enable the component 1 to be anchored into the masonry 2.

Figure 3:
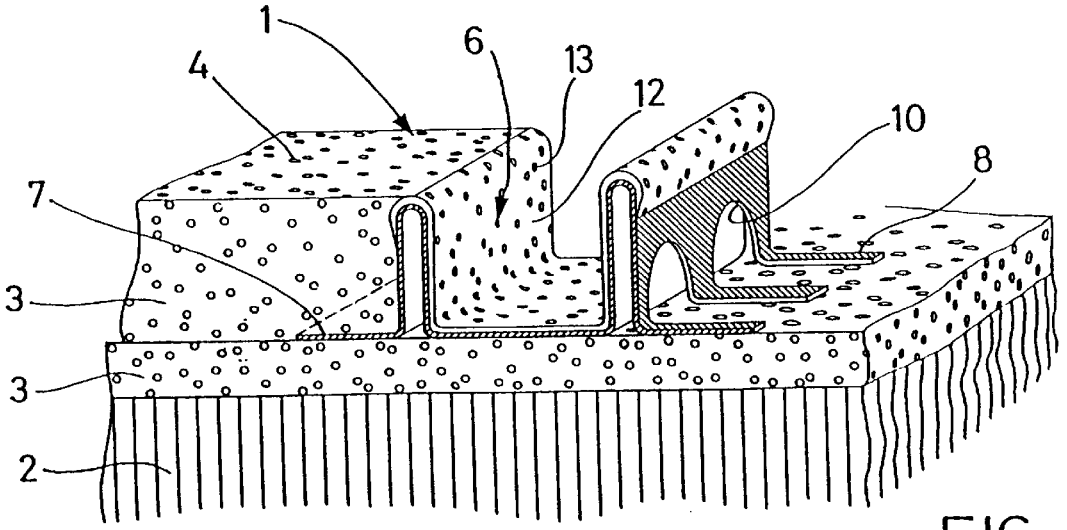
FIGS. 3 and 4 show, in perspective, metallic components according to two different embodiments.
Figure 4:
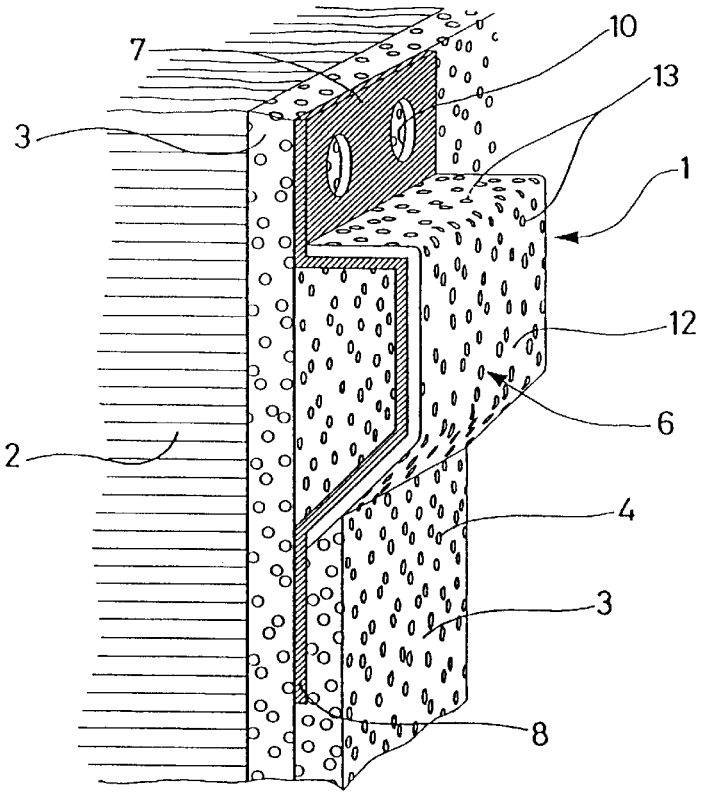

The head 6 of the component 1 is flush with the surface of the rendered wall. In the example of the present description shown in FIGS. 1*a* and 1*b,* it is in the form of a longitudinal arris intended to form the arris of the corner part 5 of the building. However, it may have any shape and size. In particular, the head of the component may be flush with the surface of the walls, just as well as it may project from said surface. This is the case of the heads of the components 1 shown in FIGS. 2, 3 and 4.

According to the invention, the head 6 of the component 1 is covered with a resin coat 12 containing a mineral filler, for example silica or calcium carbonate, and therefore showing particles 13 on its surface, the particle size of which is between 0.01 and 3 mm, more preferably between 0.1 and 1 mm and, in practice, about 0.5 mm. This coat 12 has a resin thickness of between approximately 1 and 4 mm.

Figure 5A:
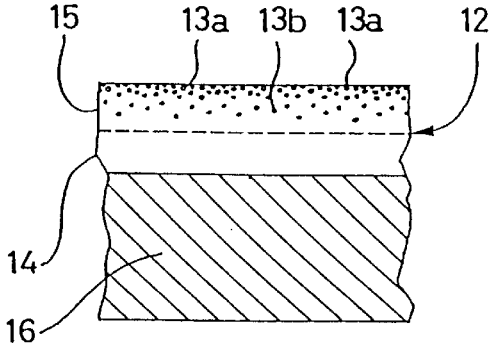
FIGS. 5*a* and 5*b* show diagrammatically, in cross section and in enlarged view, the resin coat of a component according to the invention, applied respectively according to a first or a second process.
Figure 5B:
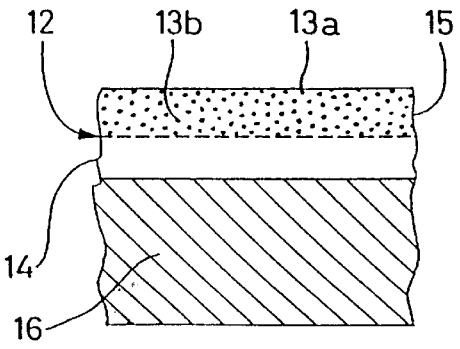

The coat 12 may be a single coat containing particles only on the surface, or particles on the surface and within the coat 12, or only particles within the coat 12. However, as is shown in FIGS. 5*a* and 5*b,* it is advantageously composed of two subcoats: a bonding subcoat 14 and a finish subcoat 15. It may be covered with a hydrophobic film which improves its impermeability properties.

The subcoat 14 is mainly composed of a thermoplastic or thermosetting polymeric resin, for example an acrylic resin, in direct contact with the metal 16 of the head 6 of the component 1. It is substantially free of particles which would have the effect of decreasing the adhesion of said subcoat 14 to the metal.

The subcoat 15 is likewise composed of a thermoplastic or thermosetting polymeric resin, for example an acrylic resin. However, it contains silica particles 13*a* and 13*b* which are flush with the surface of the head 6, and therefore are visible in the corner part of the building, or are embedded within said subcoat 15 (particles 13*b*). Advantageously, it also contains a fungicide.

In order to apply the resin coat 12 to the head 6 of the component 1, three prior operations are carried out.

In a first operation, the metal plate of the component is degreased and/or pickled in a phosphoric acid solution. This first operation has the effect of cleaning the surface of the metal of fatty substances or of oxides which could be on the surface, and thus allowing perfect adhesion of the subcoat 14.

In a second operation, the metal plate is rinsed in demineralized water until the acid is completely removed from its surface (neutral pH).

Finally, in a third operation, a bonding primer is then sprayed onto the surface of the metal plate, and in particular onto the head of said plate. This primer, which constitutes the subcoat 14, is a resin, for example an acrylic resin, in a solvent phase.

The above operations are subject to modifications depending, in particular, on the nature of the metal of which the component is made. Thus, if the component is made not of aluminum but of galvanized steel, the bonding primer will advantageously be polyurethane.

The purpose of the following operations is to produce the finish subcoat 15 of the component 1, which has an appearance similar to the appearance of the render. To achieve this, the subcoat will be produced by spraying or by deposition or by dipping, in a solvent phase.

In order to apply the subcoat 15 by spraying, in a first embodiment, two steps are carried out. In a first step, the acrylic resin, advantageously colored, is sprayed onto the bonding primer. Next, in a second step, before the polymers of which the subcoat 15 is made have polymerized, particles of silica or calcium carbonate are sprayed onto this resin. These particles then spread out over the surface of said coat, which then has a granular appearance. The process of spraying silica grains is stopped when the finish subcoat 15 no longer accepts said particles.

It will be noted that the first operations may be carried out independently of the aforementioned subsequent operations. Thus, the components of the invention may be sold with a subcoat 14, the subcoat 15 remaining to be applied.

In a second embodiment, the sprayed acrylic resin also contains particles of silica or calcium carbonate which are mixed beforehand with the resin so as to give a ready-to-use paste.

Finally, in a third embodiment, the sprayed resin contains only some of the particles. Complementary spraying makes it possible to add other particles which lie mainly on the surface of the subcoat 15.

It will be noted that spraying or, more generally, application of the particles in a second step, which results in said particles being distributed over the surface, gives the component a granular appearance which is similar to that of the render. However, these particles have a tendency, over time, to become detached from the coat 12. This is the reason why it is particularly advantageous for the subcoat 15 to contain particles which are not just distributed on its surface.

In the case of application of the finish subcoat 15 by deposition, each step described above in the case of spraying is replaced by a first step of mere deposition followed by a second step during which pressure is applied to the subcoat or the silica particles deposited. Of course, as in the previous cases, the finish coat may or may not contain, at the time of its application, particles of silica or calcium carbonate.

In the case of application of the finish coat by dipping, all that is required is to dip the metallic part of the component with its bonding primer into a bath of resin and to initiate polymerization of said resin which may or may not contain, depending on the case, particles of silica or calcium carbonate, which it is still possible to deposit or spray afterwards.

Optionally, the combination of the subcoats 14 and 15 is then coated with a hydrophobic film.

Of course, the various characteristics of the component of the invention and of the process for applying the protective coat on said component which have been described above could be adapted depending on the requirements, while still remaining within the scope of the subject matter of the invention.

I claim:

1. A metallic component comprising:

a head intended to form a visible part of an exterior surface of a building, and at least one flange which has at least one aperture and which is intended to be covered with at least one coat of a render containing a mineral filler, wherein said head is coated with a coat of a resin at least a portion of which contains a mineral filler.

2. The component as claimed in claim 1, wherein the resin coat consists of 1) a bonding subcoat in contact with the metal and substantially free of the mineral filler and 2) a finish subcoat in contact with the bonding subcoat and containing the mineral filler.

3. The component as claimed in claim 2, wherein the resin coat is applied by spraying, by simple deposition, or by dipping.

4. The component as claimed in claim 2, wherein the finish subcoat is applied to the bonding subcoat in two steps.

5. The component as claimed in claim 1, wherein the thickness of the resin coat is between approximately 1 and 4 mm.

6. The component as claimed in claim 1, wherein the mineral filler of the render is one of silica and calcium carbonate, and wherein the mineral filler of the resin coat is one of silica and calcium carbonate.

7. The component as claimed in claim 1, wherein the metal component is made of galvanized steel or aluminum, the thickness of which is between 0.1 and 2 mm.

8. The component as claimed in claim 2, wherein the mineral filler in the resin coat is composed of particles whose particle size is between 0.1 and 1 mm.

9. A component as claimed in claim 1, wherein the resin coat is coated directly upon an outer surface of the head.

10. A metallic component for attachment to a building, an exterior surface of the building being formed from a render containing a mineral filler, said metallic component comprising:

a metal flange which is configured to be coated with the render when said metallic component is attached to the building and which has at least one aperture formed therein; and a metal head which is affixed to said flange and which is configured to form a visible portion of the exterior surface of the building when said metallic component is attached to the building, an outer surface of said head being coated with a resin coat, wherein at least an outer portion of said resin coat contains a mineral filler.

11. A component as claimed in claim 10, wherein said resin coat is in contact with an outer surface of said head.

12. A component as claimed in claim 11, wherein said resin coat includes 1) a bonding subcoat which is coated directly upon said outer surface of said head and which is at least substantially free of the mineral filler and 2) a finish subcoat which is coated directly upon an outer surface of said bonding subcoat and which contains the mineral filler.

13. A metallic component for attachment to a building, an exterior surface of the building being formed from a render containing a mineral filler, said metallic component comprising:

a metal flange which is configured for attachment to the building and which is configured to be coated with the render when said metallic component is attached to the building; and a metal head which is formed integrally with said metal flange and which is configured to form a visible portion of the exterior surface of the building when said metallic component is attached to the building, at least an outer surface of said head being coated with a resin coat which is coated directly onto said outer surface of said head, wherein at least an outer portion of said resin coat contains a mineral filler.

14. The component as claimed in claim 13, wherein said resin coat includes 1) a bonding subcoat which is coated directly upon said outer surface of said head and which is at least substantially free of mineral filler and 2) a fish subcoat which is in contact with an outer surface of said bonding subcoat and which contains the mineral filler.

15. In combination:

a building having an exterior surface which is formed from a render containing a mineral filler; and a metallic component comprising a metal flange which is attached to said building and which is coated with said render, and a metal head which is formed integrally with said flange and which form a visible portion of said exterior surface of said building, an outer surface of said head being coated with a resin coat which is coated directly upon said outer surface of said head, wherein at least an outer portion of said resin coat contains a mineral filler.

16. The combination as claimed in claim 15, wherein said resin coat includes 1) a bonding subcoat which is coated directly upon said outer surface of said head and which is at least substantially free of the mineral filler, and 2) a finish subcoat which is coated directly upon an outer surface of said bonding subcoat and which contains the mineral filler.

17. A method comprising:

forming a metal component configured for attachment to a building, said metallic component comprising 1) a metal flange which is configured to be coated with a render and 2) a head which is configured to form visible portion of an exterior surface of the building when said metallic component is attached to the building; and then applying a resin coat directly to an outer surface of said head, at least an outer portion of said resin coat containing a mineral filler.

18. The method as claim 17, wherein the applying step comprises applying a bonding sub at directly onto said outer surface of said head, said bonding subcoat being at least substantially free of the mineral filler, and then applying a finish subcoat directly onto an outer surface of said bonding subcoat, said finish subcoat containing the mineral filler.

19. The method as claimed in claim 18, wherein the applying step comprises first spraying said bonding subcoat onto said outer surface of said head, and then applying said finish subcoat onto said outer surface of said bonding subcoat by one of spraying, simple deposition, and dipping.

20. The method as claimed in claim 17, further comprising attaching said metallic component to the building with said head facing outwardly with respect to an exterior surface of said building, then coating said flange with a render coating which forms the exterior surface of said building and which contains a mineral filler, thereby forming an exterior surface of the building comprising 1) said render coating and 2) said resin coating.

* * * * *